US010132334B2

(12) United States Patent
Whitby

(10) Patent No.: US 10,132,334 B2
(45) **Date of Patent: *Nov. 20, 2018**

(54) MAGNETORHEOLOGICAL FLUID LOCKING SYSTEM

(71) Applicant: Cameron International Corporation, Houston, TX (US)

(72) Inventor: Ross Whitby, Houston, TX (US)

(73) Assignee: Cameron International Corporation, Houston, TX (US)

( * ) Notice: Subject to any disclaimer, the term of this patent is extended or adjusted under 35 U.S.C. 154(b) by 25 days.

This patent is subject to a terminal disclaimer.

(21) Appl. No.: 15/276,577

(22) Filed: Sep. 26, 2016

(65) Prior Publication Data

US 2017/0108018 A1 Apr. 20, 2017

Related U.S. Application Data

(63) Continuation of application No. 14/145,613, filed on Dec. 31, 2013, now Pat. No. 9,453,386.

(51) Int. Cl.

| | |
|---|---|
| ***E21B 23/04*** | (2006.01) |
| ***E21B 33/06*** | (2006.01) |
| ***E21B 17/043*** | (2006.01) |
| ***F15B 15/14*** | (2006.01) |
| ***E21B 34/16*** | (2006.01) |
| ***F15B 21/06*** | (2006.01) |
| ***F15B 15/26*** | (2006.01) |

(52) U.S. Cl.

CPC ..... *F15B 15/1466* (2013.01); *E21B 33/062* (2013.01); *E21B 33/063* (2013.01); *E21B 34/16* (2013.01); *F15B 15/261* (2013.01); *F15B 15/264* (2013.01); *F15B 21/065* (2013.01); *F15B 2015/268* (2013.01)

(58) Field of Classification Search

CPC ..... E21B 23/04; E21B 33/06; E21B 17/043; E21B 34/102

See application file for complete search history.

(56) References Cited

U.S. PATENT DOCUMENTS 4,147,325 A 4/1979 McGee
4,199,131 A 4/1980 Boski et al.
(Continued)

FOREIGN PATENT DOCUMENTS

DE 1163149 B 2/1964
DE 10124365 A1 12/2002
(Continued)

OTHER PUBLICATIONS

John, Shaju et al.; A Magnetorheological Actuation System: Test and Model; Smart Materials and Structures; Feb. 29, 2008; United Kingdom.

(Continued)

*Primary Examiner* — Cathleen R Hutchins
(74) *Attorney, Agent, or Firm* — Helene Raybaud

(57) ABSTRACT

A system, including a magnetorheological (MR) fluid locking system, including a housing, a piston disposed in the housing, wherein the piston is configured to move axially within the housing, an MR fluid disposed in the housing, an MR fluid pump fluidly coupled to the housing, wherein the MR fluid pump is configured to pump the MR fluid into the housing, and an electromagnet configured to magnetize the MR fluid to control axial movement of the piston.

20 Claims, 6 Drawing Sheets

(56) References Cited

U.S. PATENT DOCUMENTS

| | | | |
|---|---|---|---|
| 6,006,647 | A | 12/1999 | Van Winkle |
| 6,463,736 | B1 | 10/2002 | Pohl |
| 6,871,618 | B2 | 3/2005 | Masse |
| 7,428,922 | B2 | 9/2008 | Fripp et al. |
| 2002/0114900 | A1 | 8/2002 | Szalony |
| 2003/0019622 | A1 | 1/2003 | Goodson, Jr. et al. |
| 2006/0260891 | A1 | 11/2006 | Kruckemeyer et al. |
| 2009/0294231 | A1 | 12/2009 | Carlson et al. |
| 2010/0038195 | A1 | 2/2010 | Kojima |
| 2011/0297394 | A1 | 12/2011 | VanDelden |
| 2013/0068479 | A1 | 3/2013 | AlDossary |
| 2013/0264503 | A1 | 10/2013 | Jahnke |
| 2013/0334449 | A1 | 12/2013 | Muci et al. |
| 2014/0299801 | A1 | 10/2014 | Alred et al. |

FOREIGN PATENT DOCUMENTS

| | | | |
|---|---|---|---|
| DE | 102004046073 | A1 | 3/2006 |
| WO | 2008/014039 | A2 | 1/2008 |
| WO | 2009/030925 | A2 | 3/2009 |
| WO | 2009/055199 | A2 | 4/2009 |
| WO | 2014/168966 | A2 | 10/2014 |

OTHER PUBLICATIONS

Nguyen, Q H et al.; An Analytical Method for Optimal Design of MR Valve Structures; Smart Materials and Structures; Aug. 10, 2009; United Kingdom.

Hitchcock, Gregory H. et al.; A New Bypass Magnetorheological Fluid Damper; Journal of Vibration and Acoustics; vol. 129; pp. 641-647; Oct. 2007; United States.

Eric H. Anderson, et al.; "Magnetorheological-Fluid Damper with Integral Step-And-Repeat Actuator"; World Scientific; Mountain View, CA (2006); 7 pages.

Shawn P. Kelso, et al.; "Precision Controlled Actuation and Vibration Isolation Utilizing Magnetorheological (MR) Fluid Technology"; American Institute of Aeronautics and Astronautics; Albuquerque, NM (2001); 8 pages.

Sean Kelso, et al.; "Experimental Validation of Novel Stictionless Magnetorheological Fluid Isolator"; SPIE Conference on Smart Structures and Materials; San Diego, CA (2003); 13 pages.

PCT International Search Report and Written Opinion; Application No. PCT/US2014/066907; dated Oct. 22, 2015; 14 pages.

MAGNETORHEOLOGICAL FLUID LOCKING SYSTEM

CROSS REFERENCE TO RELATED APPLICATION

This application claims priority to and benefit of (and is a continuation of) U.S. patent application Ser. No. 14/145,613, entitled "MAGNETORHEOLOGICAL FLUID LOCKING SYSTEM", filed Dec. 31, 2013, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity. When a desired resource is discovered below the surface of the earth, drilling and production systems are often employed to access and extract the resource. These systems may use devices to control fluid flow (e.g., oil or gas) in mineral extraction operations. These devices may operate using hydraulics, which open and close the devices using hydraulic pressure. However, maintaining the devices in a closed position may involve continuous application of hydraulic pressure.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a magnetorheoligical (MR) fluid locking system that assists in locking a hydrocarbon extraction component, such as a blowout preventer (BOP) system, in a closed position. For example, the MR fluid locking system may provide redundant locking of the BOP system in a closed position or assist in maintaining the BOP system in the closed position. In some embodiments, the MR fluid locking system may assist in the initial closing of the BOP system by supplementing the hydraulic pressure used to close the BOP system before locking the BOP system in the closed position. In some embodiments, the MR fluid locking system may actually close the BOP system as well as lock the BOP system in the closed position, thereby eliminating the use of another actuator such as a hydraulic actuator. The MR fluid locking system may also work with other locking systems to include a screw type locking system or a wedge type locking system. The MR fluid locking system thereby increases the BOP system's reliability in shutting off the flow of natural resources through a wellhead.

Figure 1:
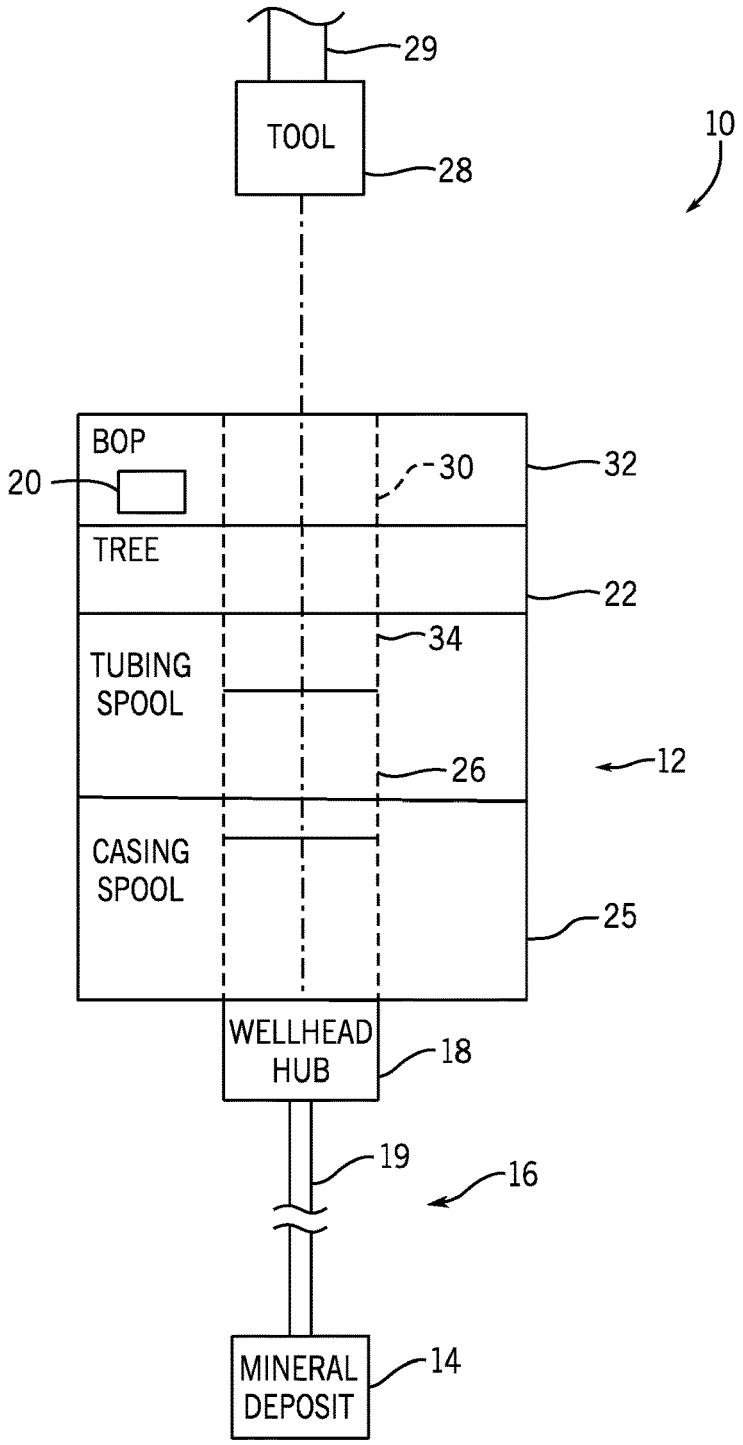
FIG. 1 is a block diagram illustrating a mineral extraction system with a magnetorheoligical (MR) fluid locking device according to an embodiment.

FIG. 1 is a block diagram that illustrates an embodiment of a hydrocarbon extraction system 10, which may employ one or more MR fluid locking systems 20 for various hydrocarbon extraction components such as valves, choke actuators, blowout preventers, and other flow control components. The illustrated hydrocarbon extraction system 10 extracts various minerals and natural resources (e.g., oil and/or natural gas), from the earth, or to inject substances into the earth. In some embodiments, the hydrocarbon extraction system 10 is land based (e.g., a surface system) or subsea (e.g., a subsea system). As illustrated, the system 10 includes a wellhead 12 coupled to a mineral deposit 14 via a well 16. The well 16 may include a wellhead hub 18 and a well bore 19. The wellhead hub 18 generally includes a large diameter hub disposed at the termination of the well bore 19 and designed to connect the wellhead 12 to the well 16. The wellhead 12 may include multiple components that control and regulate activities and conditions associated with the well 16. For example, the wellhead 12 generally includes systems that route produced minerals from the mineral deposit 14, regulate pressure in the well 16, and inject chemicals down-hole into the well bore 19.

In the illustrated embodiment, the wellhead 12 includes what is colloquially referred to as a Christmas tree 22 (hereinafter, a tree), a tubing spool 24, a casing spool 25, and a hanger 26 (e.g., a tubing hanger and/or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 29. In certain embodiments, the tool 28 includes a running tool that is lowered (e.g., run) from an offshore vessel to the well 16 and/or the wellhead 12.

The tree 22 generally includes a variety of flow paths (e.g., bores), valves, fittings, and controls for operating the well 16. Typically the tree 22 may include a frame that is disposed about a tree body, a flow-loop, actuators, and valves. Further, the tree 22 may provide fluid communication with the well 16. For example, the tree 22 includes a tree bore 30. The tree bore 30 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. Thus, enabling produced minerals to flow from the well 16 to the manifold via the wellhead 12 and/or the tree 22 before being routed to shipping or storage facilities. A blowout preventer (BOP) system 32 may also be included, either as a part of the tree 22 or as a separate device. The BOP system 32 may also have a MR fluid locking system 20 that activates and/or locks the BOP system 32 in place to prevent oil, gas, or other fluid from exiting the well in the event of an unintentional release of pressure or an overpressure condition. As will be appreciated, the well bore 19 may contain elevated pressures. For example, the well bore 19 may include pressures that exceed 10,000, 15,000, or even 20,000 pounds per square inch (psi). Accordingly, the hydrocarbon extraction system 10 may employ MR fluid locking system 20 with the BOP system 32 to control and regulate the flow of mineral flow through the well 16. In addition, the BOP system 32 may be used without a tree and during drilling operations to control the well.

Figure 2:
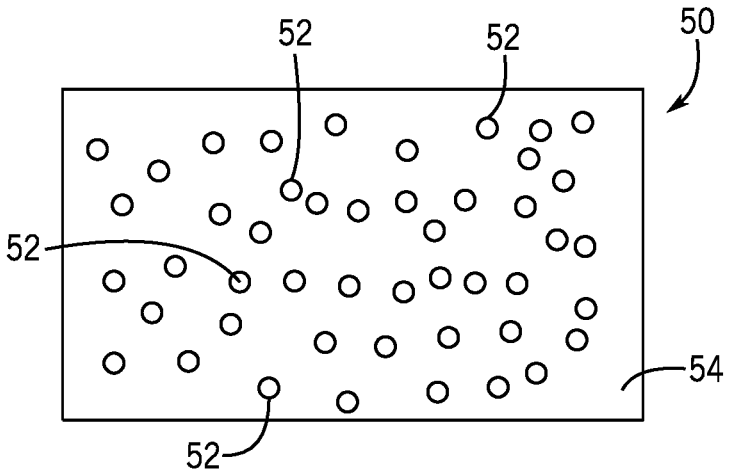
FIG. 2 is a schematic of an MR fluid in an inactive state according to an embodiment.

FIG. 2 is a schematic of a magnetorheological (MR) fluid 50 in an inactive state (e.g., a non-magnetized state). The MR fluid 50 functions as a smart fluid capable of changing viscosity when exposed to a magnetic field. The MR fluid 50 includes multiple magnetizable particles 52 (e.g., iron particles) suspended in a carrier liquid 54 (e.g., oil based liquid). The particles 52 are relatively small, (e.g., each particle having a diameter on the order of several microns). For example, the average diameter of the particles 52 may be less than approximately 5, 10, 15, 20, 25, 50, or 100 microns. The particles 52 are also magnetizable (e.g., made of a magnetizable material such as iron), such that an external magnetic field can be selectively applied to the fluid 50 to magnetize the particles 52. The carrier liquid 54 (e.g., oil) is non-magnetizable and serves to suspend and protect the particles 52. As illustrated, in an unmagnetized state, the particles 52 are randomly dispersed throughout the carrier liquid 54. The particles 52 will remain in this state until exposed to a magnetic field.

Figure 3:
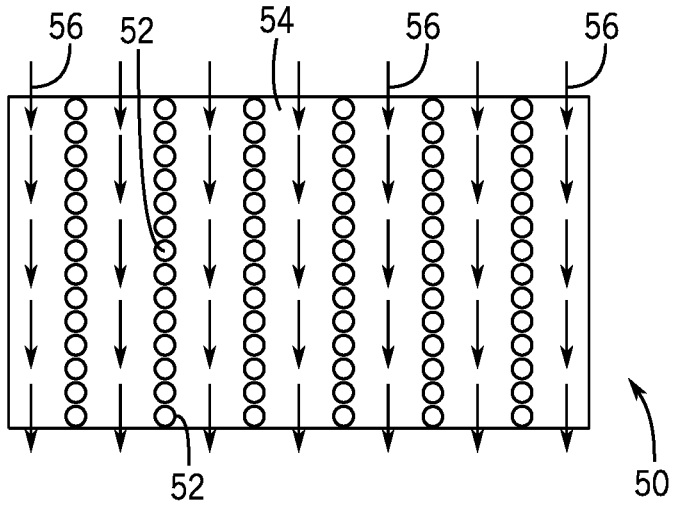
FIG. 3 is a schematic of an MR fluid in an active state according to an embodiment.

FIG. 3 is a schematic of the MR fluid 50 in an active state (e.g., a magnetized state). When exposed to a magnetic field 56, the MR fluid 50 transitions from an inactive state to an active state. In the active state, the applied magnetic field 56 magnetizes the particles 52, which attracts the particles 52 to each other. As particles 52 attract to each other, the particles 52 align in the direction of the magnetic field 56. The attraction and alignment of the particles 52 increases the viscosity and yield shear stress of the MR fluid 50, enabling the MR fluid 50 to block and resist movement. More specifically, once magnetized in the field 56, the particles 52 resist separation from one another and misalignment with the magnetic field 56. In other words, the particles 52 resist motion and continue in this state until removal or deactivation of the magnetic field 56.

The resistance of the MR fluid 50 to movement (i.e., viscosity and yield shear stress) relates to the strength of the magnetic field 56. For example, low strength magnetic fields may only moderately increase the viscosity and yield shear stress of the MR fluid 50, while high strength magnetic fields change the MR fluid 50 into a highly viscous fluid with a high yield shear stress. However, at a certain point, the strength of the magnetic field 56 will saturate the MR fluid 50 and any increase in the magnetic field will not increase the viscosity or yield shear stress of the MR fluid 50.

Figure 4:
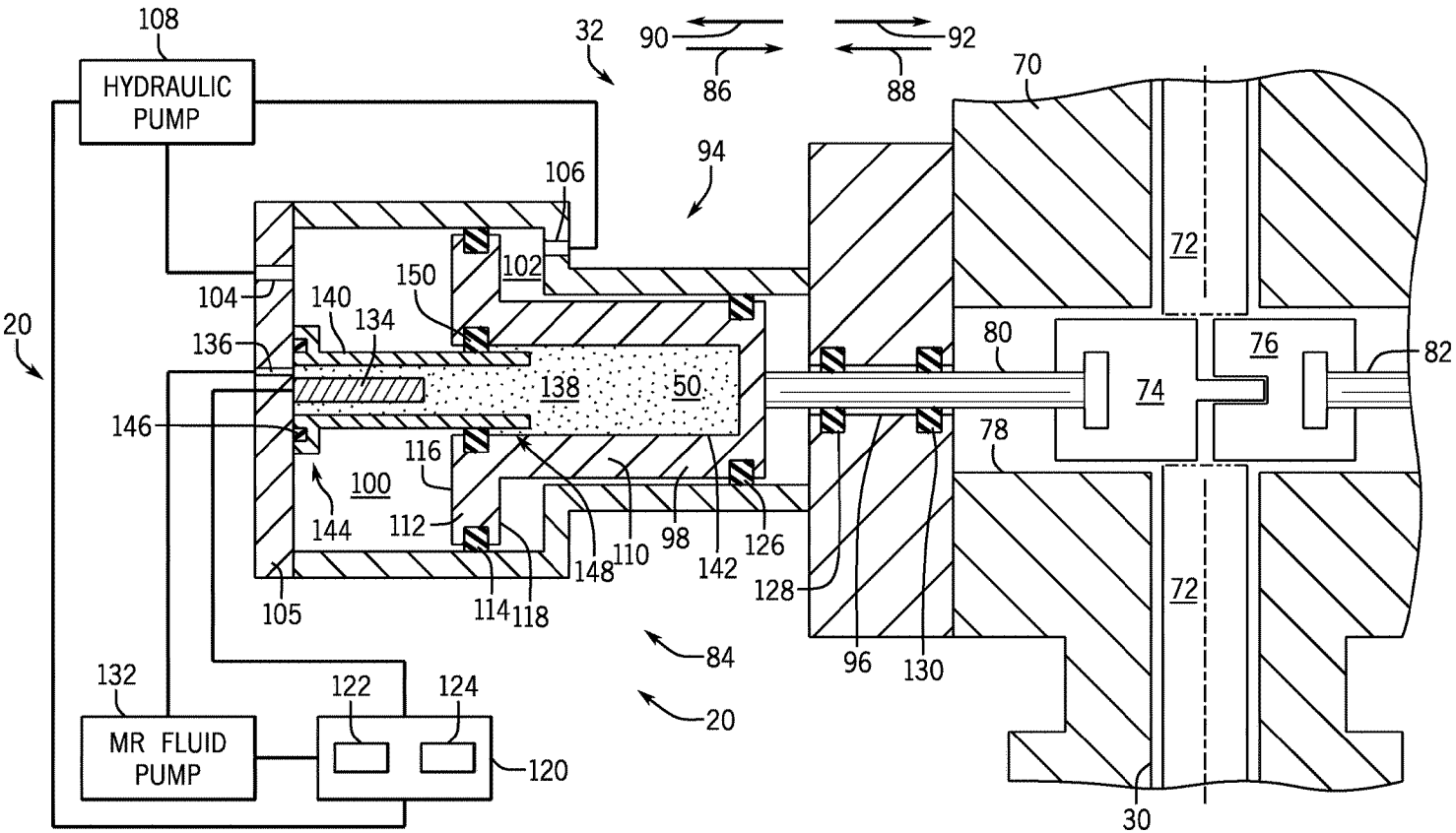
FIG. 4 is a cross-sectional view of a blowout preventer (BOP) system with an MR fluid locking device according to an embodiment.

FIG. 4 is a cross-sectional view of a hydrocarbon extraction component, (e.g., a blowout preventer (BOP) system 32), that includes a magnetorheological (MR) fluid locking system 20. The BOP system 32 includes a BOP body 70 with the tree bore 30. (However, in alternative embodiments, the BOP body 70 need not be aligned with a tree bore.) When open, the tree bore 30 enables production tubing 72 to channel natural resources (e.g., oil, natural gas) from the well 16 to an extraction point. However, in the event of an unintentional release of pressure or an overpressure condition, the hydrocarbon extraction system 10 uses the BOP system 32 to seal the tree bore 30, which blocks oil, gas, or other fluid from exiting the well 16. For example, the BOP system 32 may include a first and second ram 74, 76 capable of shearing through the production tubing 72 to block fluid from leaving the wellhead 12. The first and second rams 74, 76 rest within a ram aperture 78 and couple to respective first and second shafts 80 and 82. The first and second shafts 80 and 82 move in response to force from the BOP actuation system 84. For example, the BOP actuation system 84 may force the first and second rams 74 and 76 to move in direction 86 and 88 shearing through the production tubing 72. The BOP actuation system 84 may also open the tree bore 30 by retracting the first and second rams 74, 76 in directions 90 and 92. As the first and second rams 74 and 76 retract in directions 90 and 92, the BOP system 32 reestablishes fluid communication through the wellhead 12.

The BOP actuation system 84 includes a bonnet 94 (e.g., a housing) that couples to the BOP body 70. FIG. 4 illustrates a single bonnet 94; however, it should be understood that there may be a second bonnet coupled to the BOP body 70 opposite the bonnet 94, which actuates the ram 76. The shaft 80 extends through an aperture 96 in the bonnet 94 and couples to a cylinder 98. In operation, the cylinder 98 drives the shaft 80 axially in directions 90 and 92 to open and close the ram 74. The cylinder 98 moves in response to changing hydraulic pressure within the first and second cavities 100 and 102 as hydraulic fluid flows through the apertures 104 and 106. The cylinder 98 includes a first cylinder portion 110 and an annular flange portion 112. The flange portion 112 in combination with the annular seals 114 separate the first cavity 100 from the second cavity 102. The separation enables the hydraulic fluid to act on opposite side surfaces 116 and 118 of the flange 112.

In operation, a controller 120 controls the pump 108. For example, the controller 120 may receive a signal from a sensor or operator to close the BOP system 32 to prevent natural resources from moving through the wellhead 12. The controller 120 then executes instructions stored in memory 122 (e.g., non-transitory machine readable medium) with the processor 124 to control the pump 108. In order to close the ram 74, the pump 108 pumps hydraulic fluid through the aperture 104, in the bonnet end cover 105, and into the annular cavity 100. As the cavity 100 fills with hydraulic fluid, the hydraulic pressure increases against the flange surface 116 driving the cylinder in direction 92. Movement of the shaft 80 in direction 92 enables the ram 74, in combination with the ram 76, to shear through the production pipe 72 and seal the wellhead 12. BOP system 32 may reopen by signaling the hydraulic pump 108, with the controller 120, to pump hydraulic fluid through the aperture 106 and into the cavity 102. As the cavity 102 fills with hydraulic fluid, the hydraulic pressure increases against the flange surface 118. The increase in pressure forces hydraulic fluid out of the cavity 100 through the aperture 104 enabling the hydraulic fluid in the cavity 102 to move the shaft 80 in direction 90. In order to contain pressure within the cavity 102, the BOP system 32 includes an annular seal 126 on the first cylindrical portion 110 of the cylinder 98. In some embodiments, the bonnet 94 may also include annular seals 128 and 130 that seal the cavity 102 and block fluid flow through the tree bore 30 from entering the cavity 102.

After closing the tree bore 30, the BOP system 32 may actuate a magnetorheological (MR) fluid locking system 20. The MR fluid locking system 20 may supplement pressure provided by the hydraulic pump 108 to close the rams 74 and 76, or replace the continuous pressure from the hydraulic pump 108 that maintains the BOP system 32 in a closed position. The MR fluid locking system 20 includes an MR fluid pump 132 and an electromagnet 134. In operation, the controller 120 may signal the MR fluid pump 132 to pump MR fluid 50 through aperture 136 in the bonnet end cover 105. After passing through the aperture 136, the MR fluid enters a cavity 138, formed by a hollow cylinder 140 and an aperture 142 in the cylinder 98. As illustrated, the cylinder 140 couples to the end cover 105 around the aperture 136, and axially extends in direction 92 into the aperture 142 of the cylinder 98. The cylinder 140 forms a fluid tight seal 144 around the aperture 136, in the end cover 105, with a annular gasket 146 and a fluid tight seal 148 with the cylinder 98 using annular gasket 150. The fluid tight seals 144 and 148 enable MR fluid to enter the cavity 138 without mixing with hydraulic fluid in the cavity 100. As mentioned above, the MR fluid locking system 20 may work simultaneously with the hydraulic pump 108 to close the rams 74 and 76 (i.e., provide pressure that moves the cylinder 98). However, in some embodiments, the control system 120 may pump MR fluid 50 into the cavity 38 after closing the rams 74 and 76, or pump MR fluid 50 while closing the rams 74, 76 but without providing additional pressure. After closing the BOP system 32 and filling the cavity 138 with MR fluid, the controller 120 may execute control instructions to activate the electromagnet 132. As explained above, when exposed to a magnetic field, the MR fluid 50 transitions from an inactive state to an active state. In the active state, the applied magnetic field magnetizes particles 52 in the fluid, which attracts the particles to each other. As the particles 52 attract to each other, the particles 52 align in the direction of the magnetic field. The attraction and alignment of the particles 52 increases the viscosity and yield shear stress of the MR fluid 50, enabling the MR fluid 50 to block and resist movement (e.g., movement of the cylinder 98). The MR fluid 50 continues to resist movement until removal or deactivation of the electromagnet 134. In other words, the MR fluid locking system 20 locks the BOP system 32 in a closed position until the controller 120 execute instructions to deactivate the electromagnet 134. Once deactivated, the cylinder 98 can again move in direction 90 opening fluid communication through the wellhead 12.

Figure 5:
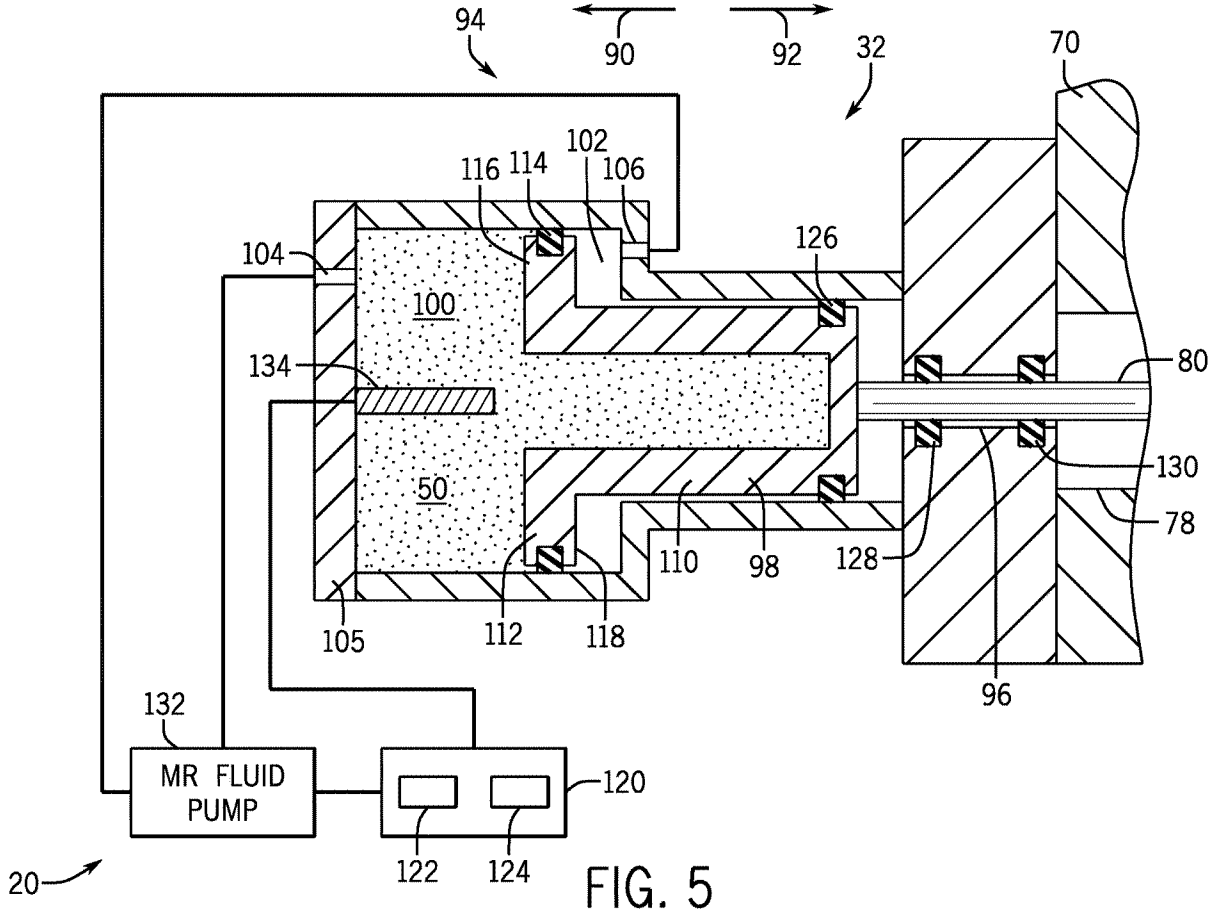
FIG. 5 is a cross-sectional view of a BOP system with an MR fluid locking device according to an embodiment.

FIG. 5 is a cross-sectional view of a BOP system 32 with an MR fluid locking system 20 that operates in a dual purpose role. First, the BOP system 32 uses the MR fluid locking system 20 to open and close the rams 74, 76. Second, the BOP system 32 uses the MR fluid locking system 20 to block axial movement of the cylinder 98 after closing the rams 74, 76. In operation, the controller 120 executes control instructions to control operation of the MR fluid pump 132 to axially drive the piston 98 and to activate the electromagnet 134. For example, the controller 120 may receive a signal from a sensor or operator and execute control instructions to close the BOP system 32, to prevent natural resources from moving through the wellhead 12. The controller 120 then executes control instructions stored in memory 122 with the processor 124 to activate the MR fluid pump 132. The MR fluid pump 132 then pumps MR fluid 50 through the aperture 104 and into the cavity 100, increasing the pressure of the MR fluid 50 on the flange surface 116. The increase in pressure on the flange surface 116 forces MR fluid 50 out of the cavity 102 through the aperture 106, enabling the MR fluid 50 in the cavity 100 to move the shaft 80 in direction 92. As the shaft 80 moves in direction 92, the ram 74, in combination with the ram 76, shear through the production pipe 72 and seal the wellhead 12 (seen in FIG. 4). In order to reopen the BOP system 32, the controller 120 executes control instructions to signal the MR fluid pump 132 to pump MR fluid 50 through the aperture 106 and into the cavity 102. As the cavity 102 fills with MR fluid 50, the MR fluid 50 increases the pressure on the flange surface 118 forcing MR fluid 50 out of the cavity 100 and through the aperture 104, thereby enabling the MR fluid 50 in the cavity 102 to move the shaft 80 in direction 90.

After closing the tree bore 30, the controller 120 may execute control instructions to actuate the electromagnet 134. As explained above, when exposed to a magnetic field, the MR fluid 50 transitions from an inactive state to an active state. In the active state, the applied magnetic field magnetizes particles 52 in the fluid, which attracts the particles 52 to each other and increases the viscosity and yield shear stress of the MR fluid 50, enabling the MR fluid 50 to block and resist movement (e.g., movement of the cylinder 98). The MR fluid 50 continues to resist movement until removal or deactivation of the electromagnet 134. In other words, the MR fluid locking system 20 locks the BOP system 32 in a closed position until the controller 120 executes control instructions to deactivate the electromagnet 134. Once deactivated, the cylinder 98 can again move in direction 90 opening fluid communication through the wellhead 12.

Figure 6:
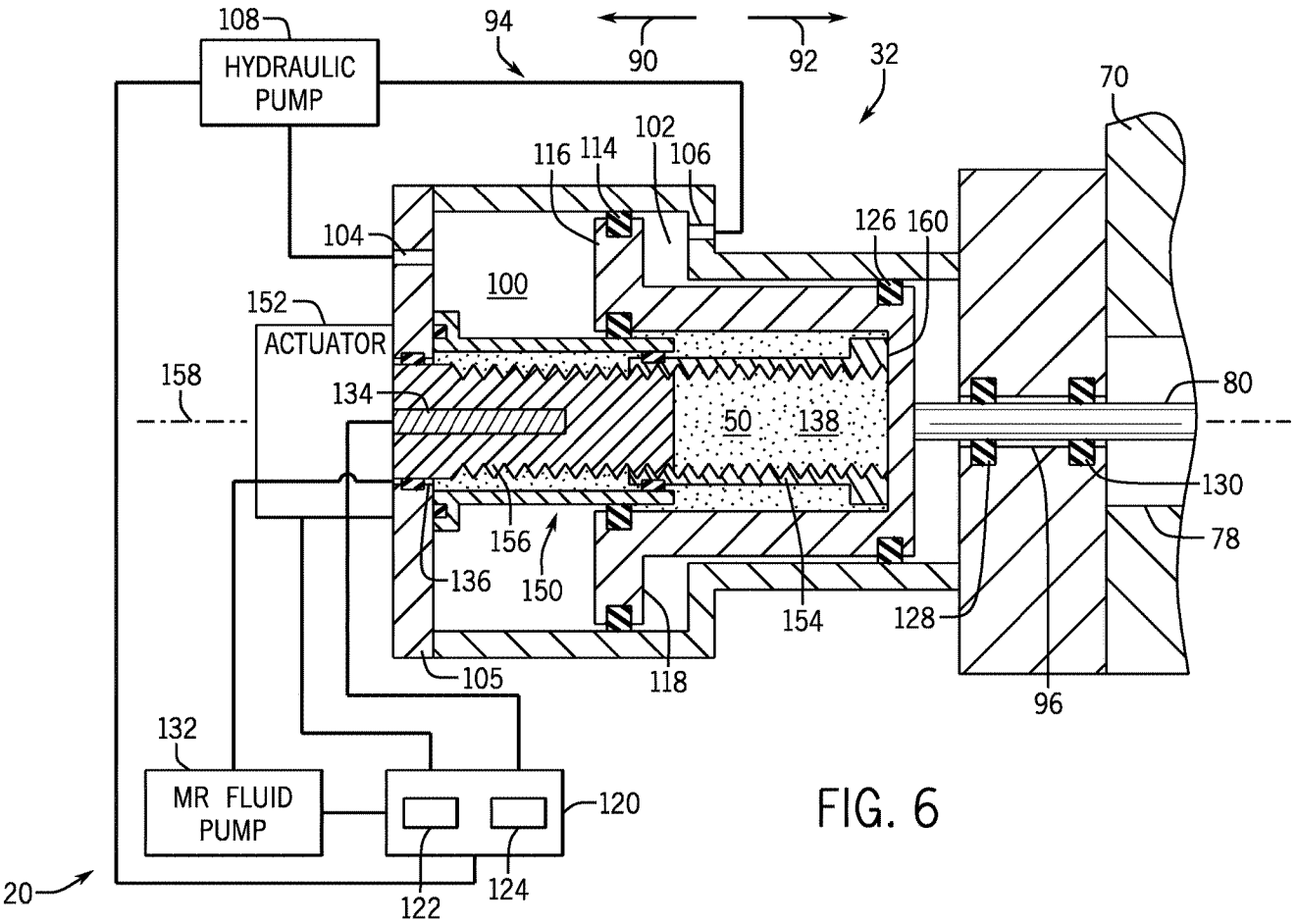
FIG. 6 is a cross-sectional view of a BOP system with an MR fluid locking device according to an embodiment.

FIG. 6 is a cross-sectional view of a BOP system 32 with an MR fluid locking system 20 in combination with a screw locking system 150. In operation, the controller 120 executes control instructions to control the opening and closing of the BOP system 32 with the pump 108. The controller 120 executes control instructions stored in the memory 122 with the processor 124 that signal the pump 108 to pump hydraulic fluid through the aperture 104 and into the cavity 100. As the cavity 100 fills with hydraulic fluid, the hydraulic fluid increases the pressure on the flange surface 116. The increase in pressure forces hydraulic fluid out of the cavity 102 through the aperture 106, enabling the hydraulic fluid in the cavity 100 to move the shaft 80 in direction 92. As the shaft 80 moves in direction 92, the shaft 80 moves the ram 74, which then shears through the production pipe 72 and seals the wellhead 12 (seen in FIG. 4).

After closing the tree bore 30, the BOP system 32 may actuate the screw locking system 150 with an actuator 152 (e.g., manual or automatic). As illustrated, the screw locking system 150 rests within the cavity 138 and includes a female lock 154 and a male screw 156. In operation, the actuator 152 rotates the male screw 156 about an axis 158 to move the female lock 154 in direction 92 and into contact with the cylinder 98. When the female lock 154 contacts the cylinder 98 the screw locking system 150 is in a locked position. In the locked position, the screw locking system 150 blocks movement of the cylinder 98 in direction 90, thus blocking the BOP system 32 from opening. The controller 108 may then execute control instructions to turn the hydraulic pump 108 off or continue to operate the pump 108 to maintain pressure in the cavity 100. In some embodiments, the BOP system 32 may include the MR fluid locking system 20 to supplement the screw locking system 150. For example, after moving the screw locking system 150 into the locking position, the controller 120 may execute control instructions to signal the MR fluid pump 132 to pump MR fluid through aperture 136 in the bonnet end cover 105. After passing through the aperture 136, the MR fluid 50 enters and fills the cavity 138. The controller 120 may then execute control instructions to activate the electromagnet 134 to magnetize particles 52 in the MR fluid 50 to increase the viscosity and yield shear stress of the MR fluid 50, enabling the MR fluid 50 to block and resist movement (e.g., movement of the cylinder 98). The MR fluid 50 continues to resist movement until removal or deactivation of the electromagnet 134. In other words, the MR fluid locking system 20 locks the BOP system 32 in a closed position until the controller 120 executes control instructions to deactivate the electromagnet 134. Once deactivated, the screw locking system 150 may retract the female lock 154 in direction 90 by rotating the male screw 156 about the axis 158 with the actuator 152. As the female lock 154 retracts in direction 90, the BOP system 32 can again move the cylinder 98 in direction 90 to open the tree bore 30 (see FIG. 4).

Figure 7:
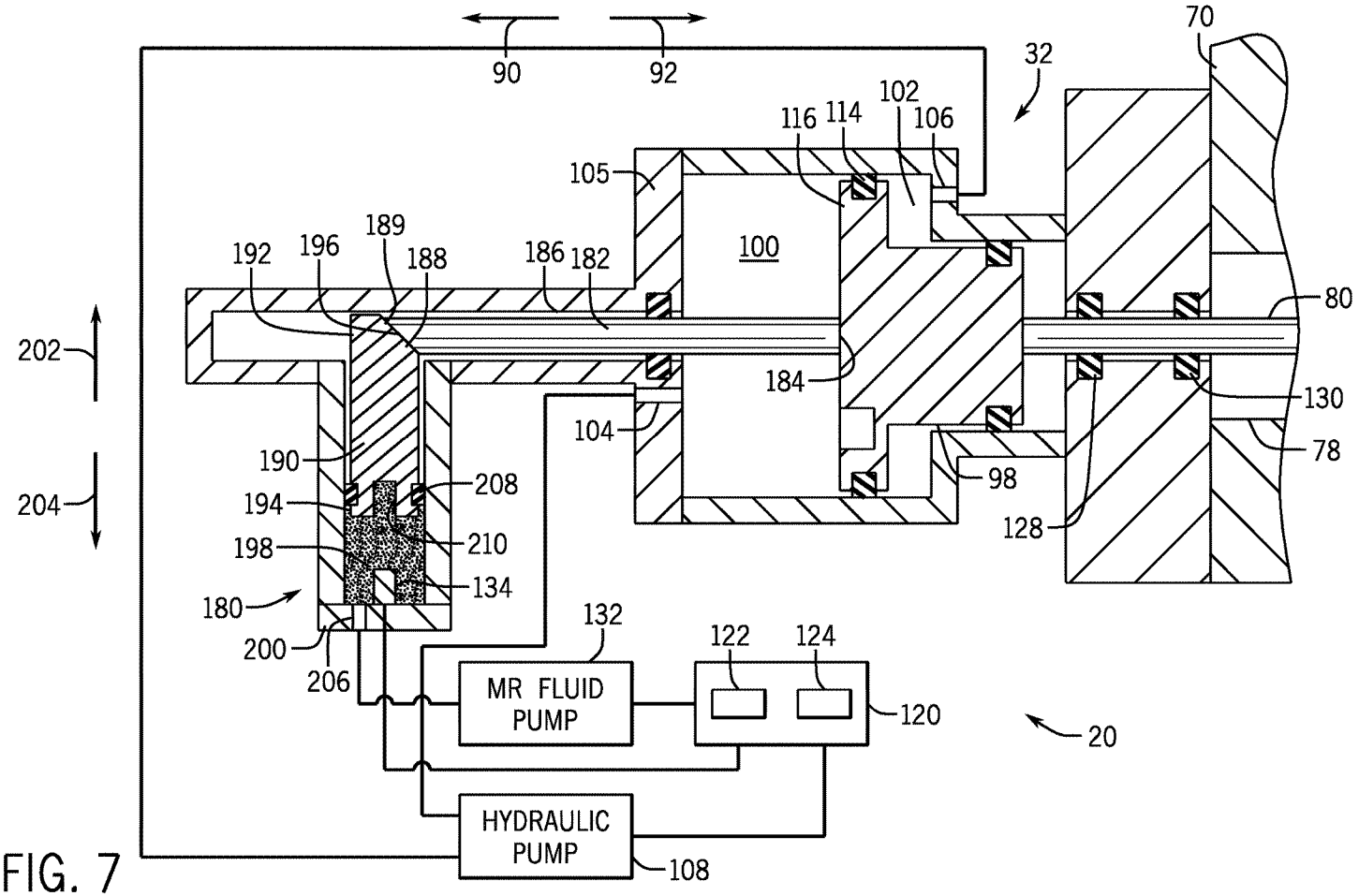
FIG. 7 is a cross-sectional view of a BOP system with an MR fluid locking device according to an embodiment.

FIG. 7 is a cross-sectional view of a BOP system 32 with an MR fluid locking system 20 in combination with a wedge locking system 180. As explained above, the controller 120 controls the opening and closing of the BOP system 32 with the pump 108. The controller 120 executes control instructions stored in the memory 122 with the processor 124 that signals the pump 108 to pump hydraulic fluid through the aperture 104 and into the cavity 100. As the cavity 100 fills with hydraulic fluid, the hydraulic fluid increases the pressure on the flange surface 116. The increase in pressure forces hydraulic fluid out of the cavity 102 through the aperture 106 enabling the hydraulic fluid in the cavity 100 to move the shaft 80 in direction 92. As the shaft 80 moves in direction 92, the shaft 80 moves the ram 74, which then shears through the production pipe 72 and seals the wellhead 12 (seen in FIG. 4).

After closing the tree bore 30, the BOP system 32 may use a wedge locking system 180 to lock the BOP system 32 in a closed position. The wedge locking system 180 includes an additional shaft 182 that couples to the cylinder 98 at a first end 184 and that axially extends through the aperture 186 of the bonnet end cover 105 to a second end 188. The second end 188 includes a tapered surface 189 that wedgingly engages a third shaft 190. Specifically, the third shaft 190 includes a first end 192 and a second end 194, with the first end 192 defining a tapered or angled surface 196. As illustrated, the third shaft 190 rests within a cavity 198 of the end cover 105 and is retained within the end cover 105 with a plate 200. The cavity 198 enables the third shaft 190 to move axially in directions 202 and 204 to engage and disengage the shaft 182. For example, in operation, the controller 120 may receive a signal indicating that the BOP system 32 has closed the tree bore 30. The controller 120 may then execute control instructions to activate the wedge locking system 180 to block axial movement of the piston 98. The controller 120 may execute control instructions to activate the wedge locking system 180 with a signal to the MR fluid pump 132 to begin pumping MR fluid 50 into the cavity 198. As MR fluid 50 enters the cavity 198 through the aperture 206 in the plate 200, the pressure of the MR fluid 50 axially drives the third shaft 190 in direction 202. More specifically, as MR fluid 50 enters the cavity 198 the annular gasket 208 blocks the MR fluid 50 from escaping the cavity 198, thereby enabling the MR fluid 50 to apply force in direction 202 on the second end 194 of the third shaft 190. The increase in pressure drives the third shaft 190 in direction 202 and into contact with the second shaft 182. As the third shaft 190 moves in direction 202, the tapered or angled surface 196 of the third shaft 190 contacts the tapered or angled surface 189 of the second shaft 182. In this position, the third shaft 190 wedgingly engages the second shaft 182 to block axial movement of the second shaft 182 in direction 90. The inability of the second shaft 182 to move in direction 90 blocks movement of the cylinder 98, and therefore blocks the BOP system 32 from opening the tree bore 30.

After pumping MR fluid 50 into the cavity 198, the controller 120 may execute control instructions to actuate the electromagnet 134. The exposure to the magnetic field transitions the MR fluid 50 from an inactive state to an active state. In the active state, the applied magnetic field magnetizes particles 52 in the fluid, which attracts the particles 52 to each other and increases the viscosity and yield shear stress of the MR fluid 50, enabling the MR fluid 50 to block and resist movement of the third shaft 190. The MR fluid 50 continues to resist movement until removal of the magnetic field. In other words, the MR fluid locking system 20 locks the BOP system 32 in a closed position until the controller 120 executes control instructions to deactivate the electromagnet 134. Once deactivated, the third shaft 190 may again move in direction 204, thereby enabling the cylinder 98 to move in direction 90 through the aperture 186. As illustrated, the second end 194 of the third shaft 190 includes a recess 210 that receives the electromagnet 134 as the third shaft 190 moves in direction 204.

Technical effects of the disclosed embodiments of the invention include a MR fluid locking system that assists in locking a hydrocarbon extraction component such as a blowout preventer (BOP) system, in a closed position. The MR fluid locking system may provide redundant locking of the BOP system in a closed position or assist in maintaining the BOP system in the closed position. The MR fluid locking system may also work with other locking systems to include a screw type locking system or a wedge type locking system to maintain the BOP system in a closed position. In this manner, the MR fluid locking system increases the BOP system's reliability in shutting off the flow of natural resources through a wellhead.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a magnetorheological fluid locking system, comprising:

a housing;

a piston disposed in the housing, wherein the piston is configured to move axially within the housing, the piston defining a cavity;

a magnetorheological fluid disposed in the cavity;

a magnetorheological fluid pump fluidly coupled to the housing, wherein the magnetorheological fluid pump is configured to pump the magnetorheological fluid into the housing; and an electromagnet configured to magnetize the magnetorheological fluid to control axial movement of the piston.

2. The system of claim 1, comprising a hydrocarbon extraction system, wherein the hydrocarbon extraction system comprises the magnetorheological fluid locking system.

3. The system of claim 2, wherein the hydrocarbon extraction system comprises a blowout preventer system configured to block fluid flow through the hydrocarbon extraction system, and wherein the blowout preventer system comprises the magnetorheological fluid locking system.

4. The system of claim 3, wherein the magnetorheological fluid locking system is configured to actuate the blowout preventer system to stop the flow of fluid through the hydrocarbon extraction system and lock the blowout preventer system in a closed position.

5. The system of claim 1, wherein the magnetorheological fluid pump is configured to move the piston by pumping additional magnetorheological fluid into the housing.

6. The system of claim 1, comprising a controller configured to activate and deactivate the electromagnet to control axial movement of the piston.

7. The system of claim 1, comprising a hydraulic fluid pump configured to pump hydraulic fluid into the housing to move the piston.

8. The system of claim 1, comprising a screw-locking device configured to control axial movement of the piston.

9. The system of claim 1, comprising a wedge-locking device configured to control axial movement of the piston.

10. A system, comprising:

a hydrocarbon extraction system, comprising:

a magnetorheological fluid locking system, comprising:

a housing;

a piston coupled to a blowout preventer ram, wherein the piston is configured to move axially within the housing to open and close a blowout preventer system;

a magnetorheological fluid within the housing;

a magnetorheological fluid pump fluidly coupled to the housing, wherein the pump is configured to pump the magnetorheological fluid into the housing;

an electromagnet configured to magnetize the magnetorheological fluid to control axial movement of the piston; and a controller coupled to the electromagnet, wherein the controller is configured to activate and deactivate the electromagnet.

11. The system of claim 10, comprising a screw-locking device configured to control axial movement of the piston.

12. The system of claim 10, comprising a wedge-locking device configured to control axial movement of the piston.

13. The system of claim 10, wherein the magnetorheological fluid pump is configured to move the piston by pumping additional magnetorheological fluid into the housing.

14. The system of claim 10, comprising a hydraulic fluid pump configured to pump hydraulic fluid into the housing to move the piston.

15. A system, comprising:

a blowout preventer system, comprising:

a magnetorheological fluid locking system, comprising:

a housing;

a piston coupled to a blowout preventer ram, wherein the piston is configured to move axially within the housing to open and close the blowout preventer system;

a magnetorheological fluid within the housing;

a magnetorheological fluid pump fluidly coupled to the housing, wherein the pump is configured to pump the magnetorheological fluid into the housing;

an electromagnet, configured to magnetize the magnetorheological fluid to control axial movement of the piston; and a controller coupled to the electromagnet, wherein the controller is configured to activate and deactivate the electromagnet.

16. The system of claim 15, wherein the magnetorheological fluid pump is configured to move the piston by pumping additional magnetorheological fluid into the housing.

17. The system of claim 15, comprising a hydraulic fluid pump configured to pump hydraulic fluid into the housing to move the piston.

18. The system of claim 15, wherein the electromagnet is external to the housing.

19. The system of claim 15, comprising a cylinder within the housing, wherein the cylinder is configured to form a magnetorheological fluid chamber with the piston.

20. The system of claim 15, wherein the magnetorheological fluid chamber is configured to receive a screw-locking device comprising a female threaded cylinder and a male threaded cylinder.

* * * * *